US005699709A

United States Patent [19]

Scheifele et al.

[11] Patent Number: 5,699,709

[45] Date of Patent: Dec. 23, 1997

[54] DEVICE FOR SEVERING PACKING STRIPS HAVING BLISTERS FROM A CONTINUOUS FILM

[75] Inventors: Horst Scheifele, Stuttgart; Eberhard Krieger, Weinstadt; Ulrich Heinisch, Stuttgart; Siegfried Wentsch, Winnenden, all of Germany

[73] Assignee: Robert Bosch GmbH, Stuttgart, Germany

[21] Appl. No.: 448,598

[22] PCT Filed: Oct. 14, 1994

[86] PCT No.: PCT/DE94/01213

§ 371 Date: Jun. 7, 1995

§ 102(e) Date: Jun. 7, 1995

[87] PCT Pub. No.: WO95/11783

PCT Pub. Date: May 4, 1995

[30] Foreign Application Priority Data

Oct. 29, 1993 [DD] German Dem. Rep. ..... 43 37 029.2

[51] Int. Cl.[6] ..... B26D 7/01

[52] U.S. Cl. ..... 83/236; 83/262; 83/268; 83/467.1

[58] Field of Search ..... 83/262, 236, 268, 83/465, 467.1

[56] References Cited

U.S. PATENT DOCUMENTS

| | | | |
|---|---|---|---|
| 1,569,649 | 1/1926 | Way | 83/268 |
| 2,488,205 | 11/1949 | Kopczynski | 83/268 |
| 3,315,553 | 4/1967 | Handler et al. | 83/262 |
| 3,665,795 | 5/1972 | Mayer | 83/268 |
| 3,771,394 | 11/1973 | Harris et al. | 83/262 |
| 3,838,619 | 10/1974 | Brotman et al. | 83/268 |
| 5,079,980 | 1/1992 | Oakes et al. | 83/262 |

*Primary Examiner*—Kenneth E. Peterson
*Assistant Examiner*—Sean A. Pryor
*Attorney, Agent, or Firm*—Edwin E. Greigg; Ronald E. Greigg

[57] ABSTRACT

A device for severing packing strips having blisters from a continuous film having a transport roller and, at a specific distance therefrom, a stamping device. The stamping device is combined with a stop, against which blisters of the packing strip to be stamped out run. By use of the stop, an always similar position of the blisters within the packing strip is achieved in the case of different expansion behaviors of the continuous film. By use of a buffer zone for a part of the continuous film, matching to different continuous films is achieved.

15 Claims, 1 Drawing Sheet

DEVICE FOR SEVERING PACKING STRIPS HAVING BLISTERS FROM A CONTINUOUS FILM

PRIOR ART

The invention is directed to a device for severing packing strips having blisters from a continuous film. In a device of this type, known for example from DE 32 08 265 A1, a continuous film which is filled with tablets or the like and sealed with a covering film is conveyed by means of rollers step by step in each case by at least the width of a packing strip into the region of a stamping device. In the stamping device, individual packing strips are severed from the continuous film by means of a stamping punch and are fed, by means of a suction device, to a transport belt for further processing. In the case of the known device, it is disadvantageous that, as a result of the expansion behavior of the plastic films used for the continuous film, an offset can occur between the shaping and transport devices for the continuous film and the stamping device, in particular in the case of a change of film, as well as in the case of changing processing temperatures or inhomogeneities of the film. The result is an eccentric stamping pattern of the packing strip, so that the blisters are no longer arranged centrally in the packing strip. In comparison, both on functional grounds and on optical grounds, it is desirable that the blisters are always arranged at the locations envisaged for them, for example with the same edge spacings, within the packing strip.

ADVANTAGES OF THE INVENTION

In contrast, the device according to the invention for severing packing strips having blisters from a continuous film, has the advantage that the blisters are always arranged in the intended locations within the packing strip.

Further advantages of the device according to the invention are obvious herein from the description. By means of the formation of a buffer region for a part of the continuous film, both expansions and shrinkages of the continuous film can be compensated for. The blisters are positioned especially accurately and reliably within the packing strip if the shape of the stop is matched to the peripheral shape of the blisters. Furthermore, it is advantageous if the stop is arranged interchangeably on the device. By this means, a particularly simple matching to various blister shapes or arrangements of the blisters in the continuous film can be achieved.

DRAWING

An exemplary embodiment of the invention is shown in the drawing and is explained in more detail in the following description.

FIG. 1 shows a device for severing packing strips having blisters from a continuous film, simplified in side view, and FIG. 2 shows a top view of packing strip.

DESCRIPTION OF THE EXEMPLARY EMBODIMENT

Figure 1:
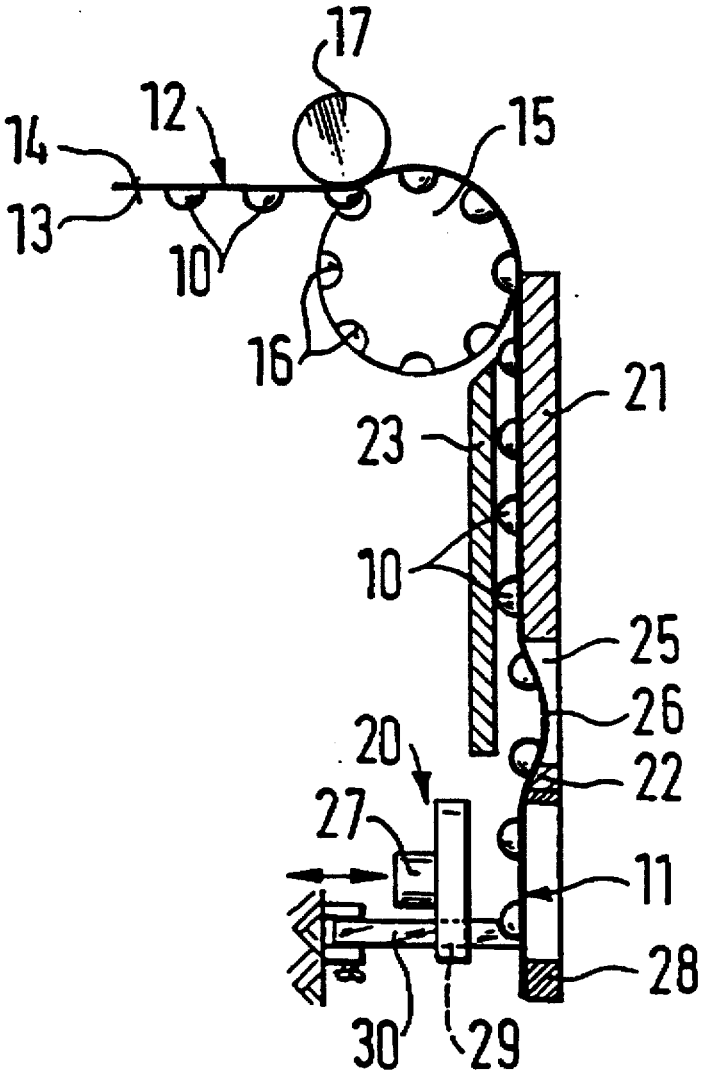
Figure 2:
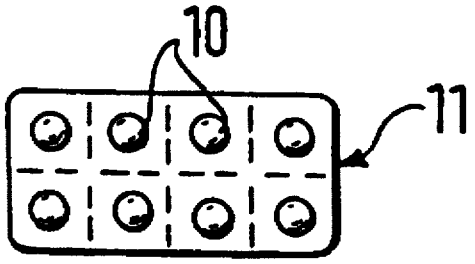

The device for severing packing strips 11 having blisters 10 from a continuous film 12, which is formed from a lower film 13 and a covering film 14, adjoins a filling and sealing device of a packaging machine, not shown. In carrying out the invention, a deep drawing process is used. A deep drawing process is one in which a flat plate or flat sheet is converted into a simple three-dimensional shaped body.

There, using the deep drawing process, blisters 10 are formed in the lower film 13, said blisters are filled, for example with tablets or the like, and the lower film 13 is subsequently sealed with the covering film 14. The continuous film 12 thus formed passes into a transport roller 15, in which cutouts 16 are formed, which receive the blisters 10 in a positive manner. In the entry region of the transport roller 15, there is arranged a nip roller 17 for guiding the continuous film 12 into the transport roller 15. Instead of the transport roller 15, however, advance devices of other designs are also conceivable for the continuous film 12. The transport roller 15 conveys the continuous film 12, in each case by the width of a packing strip 11 to be severed, step by step into a stamping device 20 arranged at a spacing from the transport roller 15 which is determined by several packing strip widths. Between the transport roller 15 and the stamping device 20, there are arranged, for the broad sides of the continuous film 12, guide elements, for example guide plates 21 to 23, which form a passage between guide plates 21 and 23. On one broad side of the continuous film 12, the guide plates 21 to 23 have a buffer region 25 free for a part of the continuous film 12, in this buffer region the continuous film can, for example, form a bulge 26. The stamping device 20 has a stamp 27, which can be moved to and fro transversely to the conveying direction of the continuous film 12 and, together with a corresponding matrix 28, defines the outer outlines of the packing strip 11. The stamp 27 stamps one packing strip 11 in each case out of the continuous film 12 during the working stroke. The stamped-out packing strips 11 are subsequently pushed out by the stamp 27 through the matrix 28 to a conveying device, not shown, from where they pass into a device for packing a plurality of packing strips 11.

A perforation 29, which is penetrated by a stop 30, is formed in the stamp 27. The stop 30 is arranged rigidly and interchangeably on the device, so that the stamp 27, during the stamping stroke, moves parallel to the stop 30 and surrounding the latter. The stop 30 reaches as far as into the plane of the continuous film 12, so that, during advancing of the continuous film 12, at least one blister 10 runs against the stop 30. In an advantageous manner, the side of the stop 30, against which the continuous film 12 is conveyed, is matched to the shape of the blisters 10, so that the latter run against the stop 30 in a positive manner. The position of the stop 30 with reference to the stamp 27 is selected such that the blisters 10 are located at a desired location within the outer contour of the packing strip 11. Furthermore, it is advantageous if the stop 30 is formed in such a way that not only one blister 10, but, for example, all blisters 10 of a row of blisters of a packing strip 11 running transversely to the advance direction of the continuous film 12 run against a correspondingly matched stop 30.

The device according to the invention functions as follows:

The continuous film 12, as already mentioned, is conveyed by means of the transport roller 15 step by step in the stamping device 20 and runs with its blisters 10 which are furthest forward in the advance direction against the stop 30. As a result of the running of the blisters 10 onto the stop 30, a same position of the blisters 10 in the packing strip 11, with reference to the stamping device 20, is achieved in each case. After the stamping out of a packing strip 11 from the continuous film 12, the latter is correspondingly moved further by the width of one packing strip 11. In this arrangement, it is advantageous to select the spacing between the transport roller 15 and the stamping device 20, or the advance of the transport roller 15, in such a way that part of the continuous film 12 bulges out in the buffer region 25. The bulged-out part of the continuous film 12 enables the blisters 10 furthermore to run against the stop 30, even if the continuous film 12, because of its expansion behavior, for example following a film change or in the case of changed processing temperatures, had shrunk. Furthermore, an expanding continuous film 12 can be stored, to a certain extent, in a simple manner in the buffer region 25 and form a buffer, without matching operations having to be undertaken on the device.

The above-described device demonstrates the waste-free stamping out of packing strips 11 from a continuous film 12, in which waste strips occur only at the edge. It is self-evident that, on the device according to the invention, packing strips 11 can also be stamped out of a continuous film 12, a stamped lattice remaining as waste. Apart from a larger advance distance of the transport roller 15, a device for removing the stamped lattice is also necessary for this purpose.

The foregoing relates to preferred exemplary embodiments of the invention, it being understood that other variants and embodiments thereof are possible within the spirit and scope of the invention, the latter being defined by the appended claims.

We claim:

1. A device for severing packing strips (11) having blisters (10) from a continuous film (12), having an advance device (15) that conveys the continuous film (12) step by step by at least a width of a packing strip (11), and having a severing tool (20) having a continuous outer cutting edge that determines an outer contour of the packaging strip (22) and adjoining at a specific distance in a conveying direction, a stop (30) is arranged in a covering region of the severing tool (20) and positioned to abut at least one blister (10) of the packing strip (11) to be severed, and wherein the stop (30) penetrates a cutout (29) in the severing tool (20), said cutout being within the bounds of said continuous outer cutting edge, said stop being parallel to a direction of motion of the severing tool.

2. The device as claimed in claim 1, wherein a buffer region (25) for a part (26) of the continuous film (12) is formed between the advance device (15) and the severing tool (20).

3. The device as claimed in claim 2, wherein between the advance device (15) and the severing tool (20), in a region of broad sides of the continuous film (12) there are arranged guide elements (21 to 23) for the continuous film (12), which are free of the buffer region (25).

4. The device as claimed in claim 3, wherein the advance device is a transport roller (15), in which cutouts (16) for the blisters (10) are formed.

5. The device as claimed in claim 3, wherein a shape of the stop (30) is matched on a side facing the continuous film (12), to a shape of at least one blister (10).

6. The device as claimed in claim 3, wherein the stop (30) is interchangeable.

7. The device as claimed in claim 2, wherein a shape of the stop (30) is matched on a side facing the continuous film (12), to a shape of at least one blister (10).

8. The device as claimed in claim 2, wherein the stop (30) is interchangeable.

9. The device as claimed in claim 2, wherein the advance device is a transport roller (15), in which cutouts (16) for the blisters (10) are formed.

10. The device as claimed in claim 1, wherein the advance device is a transport roller (15), in which cutouts (16) for the blisters (10) are formed.

11. The device as claimed in claim 1, wherein a shape of the stop (30) is matched on a side facing the continuous film (12), to a shape of at least one blister (10).

12. The device as claimed in claim 11, wherein the stop (30) is interchangeable.

13. The device as claimed in claim 11, wherein the advance device is a transport roller (15), in which cutouts (16) for the blisters (10) are formed.

14. The device as claimed in claim 1, wherein the stop (30) is interchangeable.

15. The device as claimed in claim 14, wherein the advance device is a transport roller (15), in which cutouts (16) for the blisters (10) are formed.

* * * * *